US009510091B2

(12) United States Patent
Katsuda et al.

(10) Patent No.: US 9,510,091 B2
(45) Date of Patent: Nov. 29, 2016

(54) MICROPHONE

(71) Applicant: CASIO COMPUTER CO., LTD., Shibuya-ku, Tokyo (JP)

(72) Inventors: Hiroshi Katsuda, Kodaira (JP); Akihisa Ohmura, Tachikawa (JP); Akira Suzuki, Fuchu (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/798,816

(22) Filed: Jul. 14, 2015

(65) Prior Publication Data

US 2016/0037256 A1 Feb. 4, 2016

(30) Foreign Application Priority Data

Jul. 31, 2014 (JP) ..... 2014-156859

(51) Int. Cl.
*H04R 9/08* (2006.01)
*H04R 1/44* (2006.01)
*H04R 1/02* (2006.01)

(52) U.S. Cl.
CPC . *H04R 1/44* (2013.01); *H04R 1/02* (2013.01)

(58) Field of Classification Search
CPC ..... H04R 11/04
USPC ..... 381/355; 367/141
See application file for complete search history.

(56) References Cited

U.S. PATENT DOCUMENTS 6,018,585 A 1/2000 Akino et al.
2011/0013799 A1* 1/2011 Fang ..... H04R 1/086 381/355

FOREIGN PATENT DOCUMENTS

JP 2001128272 A 5/2001
JP 2002186075 A * 6/2002
JP 3629084 B2 3/2005

OTHER PUBLICATIONS

Japanese Office Action (and English translation thereof) dated Oct. 4, 2016, issued in counterpart Japanese Application No. 2014-156859.

* cited by examiner

*Primary Examiner* — Curtis Kuntz
*Assistant Examiner* — Julie X Dang
(74) *Attorney, Agent, or Firm* — Holtz, Holtz & Volek PC

(57) ABSTRACT

When external pressure extremely increases, a waterproof vibration membrane tends to be resiliently deformed extremely toward the inside. However, an inward resilient deformation inhibiting member provided on the inner side of the waterproof vibration membrane with a space therebetween inhibits this extreme inward resilient deformation of the waterproof vibration membrane, whereby the waterproof vibration membrane is prevented from being ruptured or plastically deformed. On the other hand, when the internal pressure extremely increases, the waterproof vibration membrane tends to be resiliently deformed extremely toward the outside. However, an outward resilient deformation inhibiting member provided on the outer side of the waterproof vibration membrane with a space therebetween inhibits this extreme outward resilient deformation of the waterproof vibration membrane, whereby the waterproof vibration membrane is prevented from being ruptured or plastically deformed.

13 Claims, 4 Drawing Sheets

MICROPHONE

CROSS-REFERENCE TO RELATED APPLICATION

This application is based upon and claims the benefit of priority from the prior Japanese Patent Application No. 2014-156859, filed Jul. 31, 2014, the entire contents of which are incorporated herein by reference.

BACKGROUND OF THE INVENTION

1. Field of the Invention

The present invention relates to a microphone.

2. Description of the Related Art

In some conventional waterproof microphones, an acoustic terminal unit is provided on an internal center portion of a housing having openings on opposing surfaces, waterproof vibration membranes are provided to cover the openings of the housing, and stainless meshes are provided on the inner sides of the waterproof vibration membranes with spaces therebetween, as described in Japanese Patent No. 3629084.

When this type of conventional waterproof microphone is normally being used underwater, if an external sound is transmitted to the waterproof vibration membranes via the openings of the housing, the waterproof vibration membranes are vibrated according to the sound pressure level of the transmitted sound, and the vibration is transmitted to the acoustic terminal unit via the interspaces of the stainless meshes, whereby the microphone serves as a normal microphone. In this case, the acoustic terminal unit is waterproofed by the waterproof vibration membranes, and functions as a waterproof type.

On the other hand, when water pressure extremely increases while the conventional waterproof microphone is being used underwater, the waterproof vibration membranes tend to be resiliently deformed toward the inside by an extreme amount. However, the stainless meshes provided on the inner sides of the waterproof vibration membranes with spaces therebetween inhibit these extreme inward resilient deformations of the waterproof vibration membranes, whereby the waterproof vibration membranes are prevented from being ruptured by the extreme increase in the water pressure (external pressure).

SUMMARY OF THE INVENTION

In accordance with one aspect of the present invention, there is provided a microphone having a waterproof vibration membrane, comprising: an outward resilient deformation inhibiting member which is provided on outer side of the waterproof vibration membrane with a space therebetween and inhibits outward resilient deformation of the waterproof vibration membrane.

Advantages of the invention will be set forth in the description which follows, and in part will be obvious from the description, or may be learned by practice of the invention. Advantages of the invention may be realized and obtained by means of the instrumentalities and combinations particularly pointed out hereinafter.

BRIEF DESCRIPTION OF THE DRAWINGS

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE PREFERRED EMBODIMENTS

Figure 1:
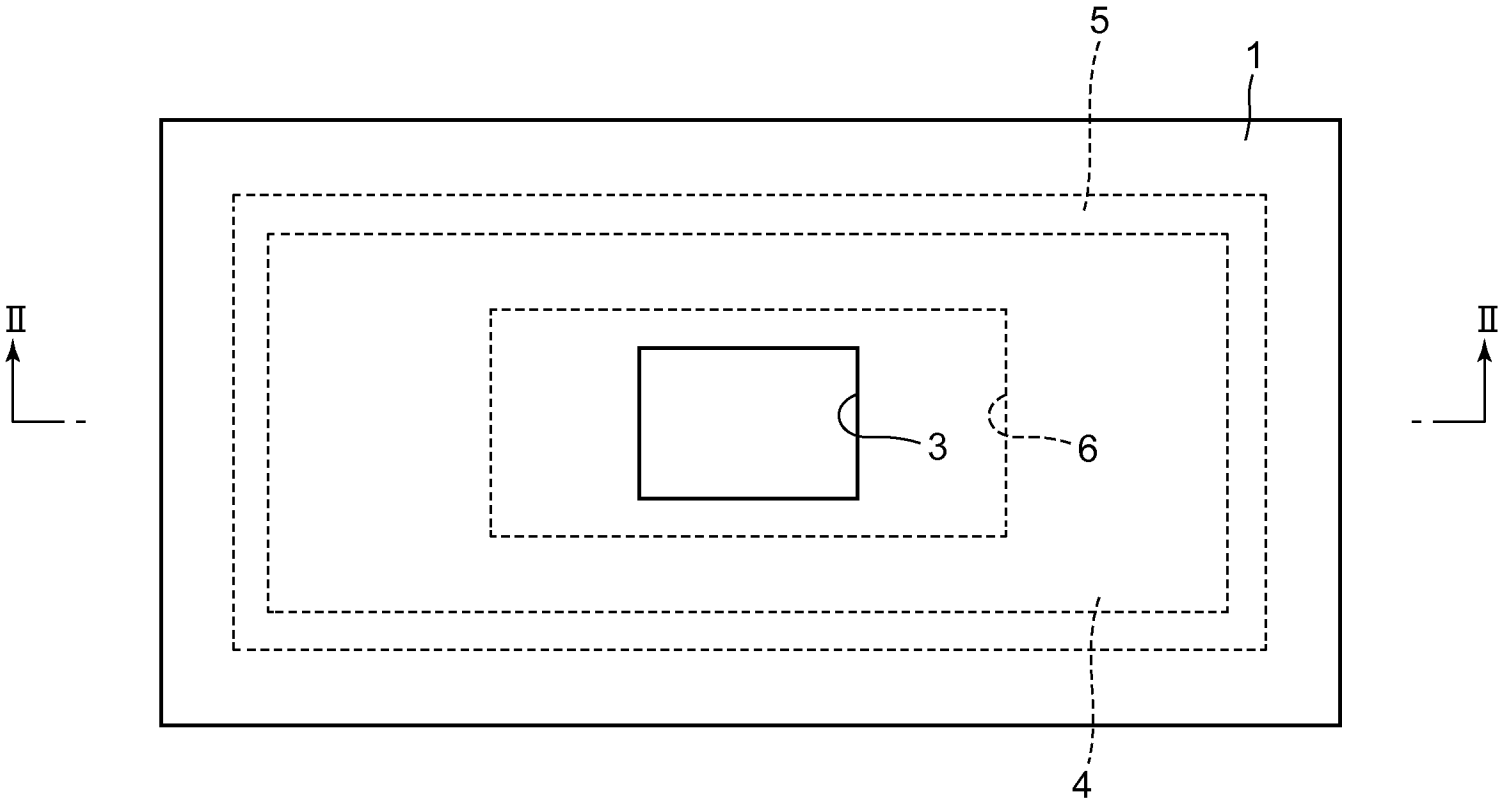
FIG. 1 is a planar view of a waterproof microphone serving as an embodiment of the present invention.
Figure 2:
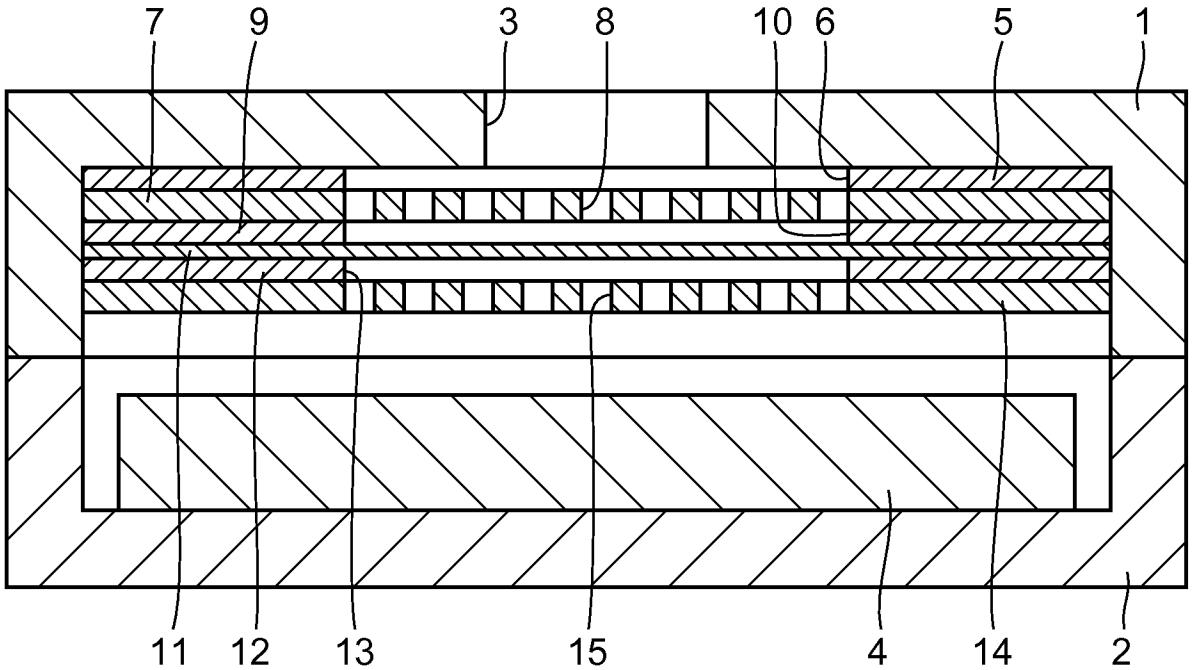
FIG. 2 is a sectional view of the waterproof microphone taken along line II-II of FIG. 1.

FIG. 1 is a planar view of a waterproof microphone serving as an embodiment of the present invention, and FIG. 2 is a sectional view of the waterproof microphone taken along line II-II of FIG. 1. This waterproof microphone includes a first housing 1 having a square shape in a planar view and a second housing 2 having a square shape in a planar view and provided on the lower side of the first housing 1. In a center portion of the housing 1, a square-shaped opening 3 is provided. On a center portion of the inner surface of the second housing 2, a microphone element 4 having a square-plate shape in a planar view is provided. The microphone element 4 is constituted by a capacitor microphone, MEMS (micro-electromechanical system) microphone, or the like.

On the inner surface of the first housing 1, a third spacer 5 having a square-plate shape in a planar view and made of an adhesive, rubber, or the like is provided. In a center portion of this third spacer 5, a square-shaped opening 6 is provided. This opening 6 of the third spacer 5 has a plane size larger than that of the opening 3 of the first housing 1.

On the inner surface of the third spacer 5, an outward resilient deformation inhibiting member 7 having a square shape in a planar view and formed of a stainless plate or the like is provided. In a center portion of this outward resilient deformation inhibiting member 7, a number of small holes 8 formed of circular holes, square holes, or the like are provided. The center portion of the outward resilient deformation inhibiting member 7, that is, the formation area of these many small holes 8 has a plane size equal to that of the opening 6 of the third spacer 5.

On the inner surface of the outward resilient deformation inhibiting member 7, a first spacer 9 having a square-plate shape in a planar view and made of an adhesive, rubber, or the like is provided. In a center portion of this first spacer 9, a square-shaped opening 10 is provided. This opening 10 of the first spacer 9 has a plane size equal to that of the opening 6 of the third spacer 5.

On the inner surface of the first spacer 9, a waterproof vibration membrane 11 having a square shape in a planar view is provided. This waterproof vibration membrane 11 is formed of, for example, a membrane which has a high rigidity and a low water absorbability and through which sound vibration is favorably transmitted, so that it has a water impervious structure.

On the inner surface of the waterproof vibration membrane 11, a second spacer 12 having a square-plate shape in a planar view and made of an adhesive, rubber, or the like is provided. In a center portion of this second spacer 12, a square-shaped opening 13 is provided. This opening 13 of the second spacer 12 has a plane size equal to that of the opening 6 of the third spacer 5.

On the inner surface of the second spacer 12, an inward resilient deformation inhibiting member 14 having a square shape in a planar view and formed of a stainless plate or the like is provided. On a center portion of this inward resilient deformation inhibiting member 14, a number of small holes 15 formed of circular holes, square holes, or the like are provided. The center portion of the inward resilient deformation inhibiting member 14, that is, the formation area of these small holes 15 has a plane size equal to that of the opening 6 of the third spacer 5.

When this waterproof microphone is used normally underwater, at high altitudes, or the like, external sound is transmitted to the waterproof vibration membrane 11 via the opening 3 of the first housing 1, the opening 6 of the third spacer 5, the small holes 8 of the outward resilient deformation inhibiting member 7, and the opening 10 of the first spacer 9. Then, the waterproof vibration membrane 11 is vibrated according to the sound pressure level of the transmitted sound. This vibration is transmitted to the microphone element 4 via the opening 13 of the second spacer 12 and the small holes 15 of the inward resilient deformation inhibiting member 14, so that the microphone is used as a normal microphone. In this structure, the microphone element is waterproofed by the waterproof vibration membrane 11, and thereby functions as a waterproof type.

Figure 3:
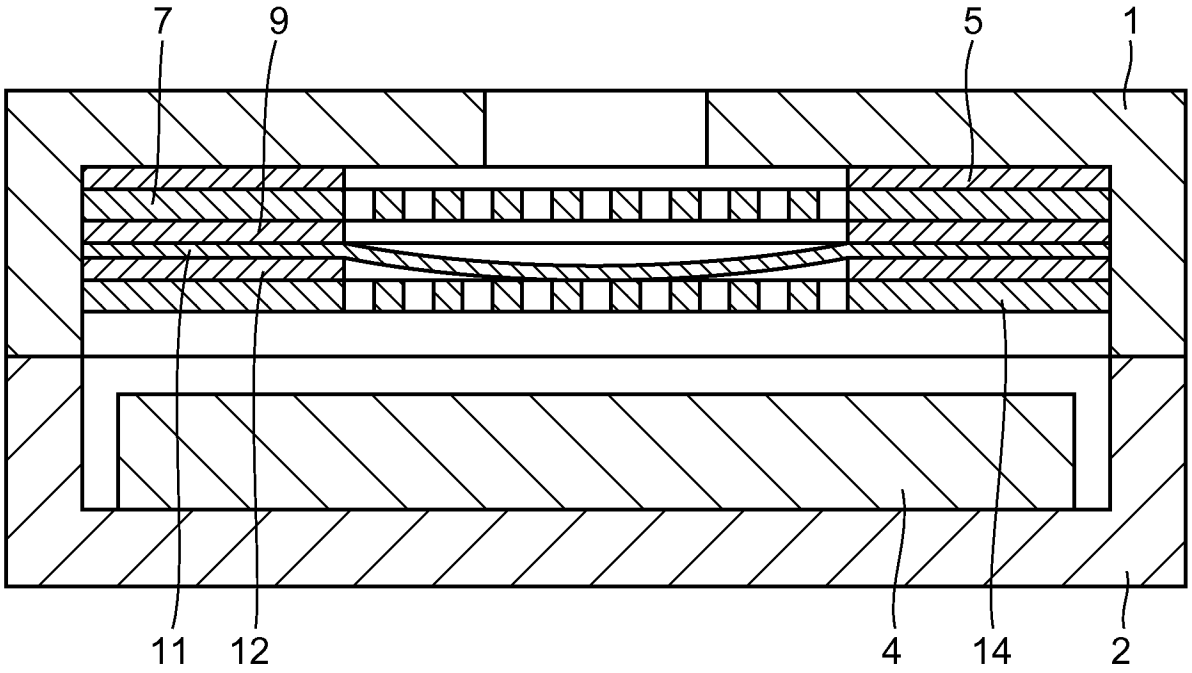
FIG. 3 is a sectional view similar to FIG. 2 for describing a case where the external pressure is extremely increased.

When water pressure (external pressure) extremely increases while the waterproof microphone is being used underwater, the waterproof vibration membrane 11 tends to be resiliently deformed extremely toward the inside. However, the inward resilient deformation inhibiting member 14 provided on the inner side the waterproof vibration membrane 11 with a space corresponding to the thickness of the second spacer 12 therebetween inhibits this extreme inward resilient deformation of the waterproof vibration membrane 11 as shown in FIG. 3, whereby the waterproof vibration membrane 11 is prevented from being ruptured or plastically deformed due to the extreme increase in the water pressure (external pressure). As such, the thickness of the second spacer 12 is designed such that the inward resilient deformation inhibiting member 14 and the waterproof vibration membrane 11 are arranged having a space therebetween by which the waterproof vibration membrane can be favorably supported by the inward resilient deformation inhibiting member 14.

Figure 4:
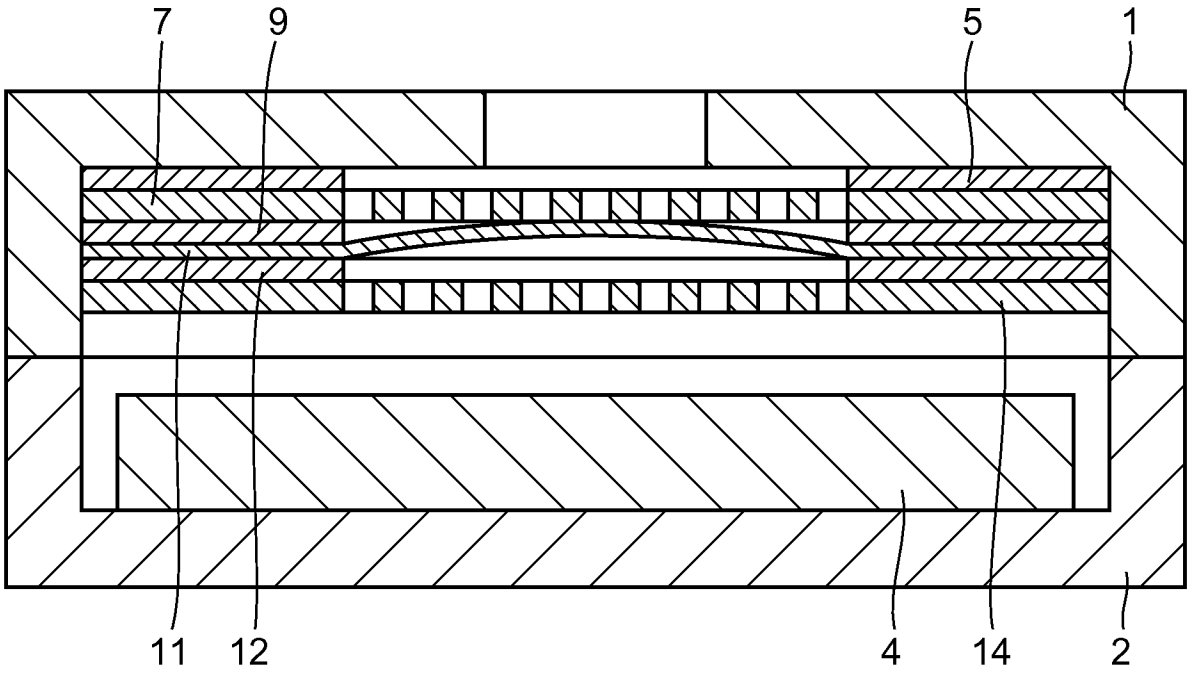
FIG. 4 is a sectional view similar to FIG. 2 for describing a case where the internal pressure is extremely increased.

When air inside the first and second housings 1 and 2 extremely is expanded due to, for example, use at an extremely low atmospheric pressure at high altitudes or partial heat generation at the time of a high load operation by a wristwatch and the like including this waterproof microphone, and the internal pressure extremely increases thereby, the waterproof vibration membrane 11 tends to be resiliently deformed extremely toward the outside. However, the outward resilient deformation inhibiting member 7 provided on the outer side of the waterproof vibration membrane 11 with a space corresponding to the thickness of the first spacer 9 therebetween inhibits this extreme outward resilient deformation of the waterproof vibration membrane 11 as depicted in FIG. 4, whereby the waterproof vibration membrane 11 is prevented from being ruptured or plastically deformed due to the extreme increase in the internal pressure. As such, the thickness of the first spacer 9 is designed such that the outward resilient deformation inhibiting member 7 and the waterproof vibration membrane 11 are arranged having a space therebetween by which the waterproof vibration membrane 11 can be favorably supported by the outward resilient deformation inhibiting member 7.

As described above, in this waterproof microphone, the inward resilient deformation inhibiting member 14 and the outward resilient deformation inhibiting member 7 are provided on the inner side and the outer side of the waterproof vibration membrane 11 with spaces therebetween. Accordingly, the inward or the outward extreme resilient deformation of the waterproof vibration membrane 11 can be inhibited by the inward resilient deformation inhibiting member 14 or the outward resilient deformation inhibiting member 7, so that the waterproof vibration membrane 11 can be prevented from being ruptured or plastically deformed even when the external pressure or the internal pressure is extremely increased.

Note that the thickness of the outward resilient deformation inhibiting member 7 and the thickness of the inward resilient deformation inhibiting member 14 may be set to be different from each other, the aperture ratio in the formation area (opening area) of the small holes 8 of the outward resilient deformation inhibiting member 7 and the aperture ratio in the formation area (opening area) of the small holes 15 of the inward resilient deformation inhibiting member 14 may be set to be different from each other, and the space between the outward resilient deformation inhibiting member 7 and the waterproof vibration membrane 11 (the thickness of the first spacer 9) and the space between the inward resilient deformation inhibiting member 14 and the waterproof vibration membrane 11 (the thickness of the second spacer 12) may be set to be different from each other, according to an environment where this waterproof microphone is mainly used.

For example, in a case where the waterproof microphone is used for a diver (or mountaineer), the thickness of the inward resilient deformation inhibiting member 14 may be set thicker than that of the outward resilient deformation inhibiting member 7 (or vice versa), the aperture ratio in the formation area of the small holes 8 of the outward resilient deformation inhibiting member 7 may be set smaller than that in the formation area of the small holes 15 of the inward resilient deformation inhibiting member 14 (or vice versa), and the space between the inward resilient deformation inhibiting member 14 and the waterproof vibration membrane 11 may be set smaller than the space between the outward resilient deformation inhibiting member 7 and the waterproof vibration membrane 11 (or vice versa) in order to, mainly, address an extreme increase in the external pressure (internal pressure). In this case, a structure where at least one of the thickness, aperture ratio, and space is different may be adopted.

In the present embodiment, the outward resilient deformation inhibiting member 7 is formed of a stainless plate or the like having the small holes 8 and the inward resilient deformation inhibiting member 14 is formed of a stainless plate or the like having the small holes 15. However, the present embodiment is not limited to this, and a structure may be adopted in which the outward and inward resilient deformation inhibiting members are each formed of a metal mesh made of stainless steel. In this structure, interspaces in the metal mesh in an area corresponding to an area other than the opening 6 of the third spacer 5 may be filled with an adhesive or the like such that the filled portion serves as a hermetic area and its inside serves as an opening area formed of the interspaces of the metal mesh.

Also, in the present embodiment, the microphone element 4 having a square shape in a planar view has been used, and the first and second casings 1 and 2 each have a square shape in a planar view. However, the present embodiment is not limited to this. A microphone element having a circular shape in a planar view may be used, and the first and second casings 1 and 2 each may have a circular shape in a planar view. In this structure, the opening 3 of the first housing 1, the openings 10, 13, and 6 of the first, second, and third spacers 9, 12, and 5, the formation area of the small holes 8 of the outward resilient deformation inhibiting member 7, and the formation area of the small holes 15 of the inward resilient deformation inhibiting member 14 may each have a circular shape.

Moreover, in the present embodiment, the third spacer 5, the outward resilient deformation inhibiting member 7, the first spacer 9, the waterproof vibration membrane 11, the second spacer 12, and the inward resilient deformation inhibiting member 14 are provided on the inner surface of the first housing 1. However, the present embodiment is not limited to this, and a structure may be adopted in which the first housing 1 is excluded, the third spacer 5, the outward resilient deformation inhibiting member 7, the first spacer 9, the waterproof vibration membrane 11, the second spacer 12, and the inward resilient deformation inhibiting member 14 are provided on the inner side of a body case of a wristwatch or the like, and the second housing 2 including the microphone element 4 is provided inside thereof.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A microphone comprising:

a waterproof vibration membrane;

a microphone element which receives a vibration as a sound from the waterproof vibration membrane;

an outward resilient deformation inhibiting member which is provided on an outer side of the waterproof vibration membrane with a first space therebetween and inhibits outward resilient deformation of the waterproof vibration membrane; and a first spacer provided between the outward resilient deformation inhibiting member and the waterproof vibration membrane, the first spacer having an opening in an area thereof.

2. The microphone according to claim 1, further comprising:

an inward resilient deformation inhibiting member which is provided on an inner side of the waterproof vibration membrane with a second space therebetween and inhibits inward resilient deformation of the waterproof vibration membrane.

3. The microphone according to claim 1, further comprising:

a housing having an opening;

wherein the outward resilient deformation inhibiting member and the waterproof vibration membrane are provided in a portion of the housing having the opening, with the outward resilient deformation inhibiting member closer to the opening than the waterproof vibration membrane; and wherein the microphone element is provided more at an interior of the housing with respect to the outward resilient deformation inhibiting member and the waterproof vibration membrane.

4. The microphone according to claim 1, wherein the outward resilient deformation inhibiting member has an opening portion, and the opening in the first spacer corresponds to the opening portion of the outward resilient deformation inhibiting member, such that the first spacer does not overlap the opening portion.

5. The microphone according to claim 4, further comprising:

an inward resilient deformation inhibiting member which is provided on an inner side of the waterproof vibration membrane with a space therebetween and inhibits inward resilient deformation of the waterproof vibration membrane, wherein the inward resilient deformation inhibiting member has an opening portion.

6. The microphone according to claim 5, further comprising:

a second spacer provided between the inward resilient deformation inhibiting member and the waterproof vibration membrane and having an opening in an area corresponding to the opening portion of the inward resilient deformation inhibiting member, such that the second spacer does not overlap the opening portion of the inward resilient deformation inhibiting member.

7. The microphone according to claim 2, wherein the outward resilient deformation inhibiting member has a thickness different from a thickness of the inward resilient deformation inhibiting member.

8. The microphone according to claim 2, wherein the first space between the outward resilient deformation inhibiting member and the waterproof vibration membrane and the second space between the inward resilient deformation inhibiting member and the waterproof vibration membrane are different from each other.

9. The microphone according to claim 5, wherein the opening portion of the outward resilient deformation inhibiting member has an aperture ratio different from an aperture ratio of the opening portion of the inward resilient deformation inhibiting member.

10. The microphone according to claim 1, wherein the first spacer has a thickness such that the waterproof vibration membrane touches the outward resilient deformation inhibiting member in response to an increase of internal pressure inside of the microphone.

11. A wearable device comprising the microphone according to claim 1.

12. The microphone according to claim 4, wherein the opening portion of the outward resilient deformation inhibiting member comprises an area of the outward resilient deformation inhibiting member in which a plurality of holes are provided.

13. The microphone according to claim 5, wherein the opening portion of the outward resilient deformation inhibiting member comprises an area of the outward resilient deformation inhibiting member in which a plurality of holes are provided; and wherein the opening portion of the inward resilient deformation inhibiting member comprises an area of the inward resilient deformation inhibiting member in which a plurality of holes are provided.

* * * * *